US008143772B2

(12) United States Patent
Francesconi

(10) Patent No.: US 8,143,772 B2
(45) Date of Patent: Mar. 27, 2012

(54) SPARK PLUG COMPRISING A GROUND ELECTRODE SUPPORT

(76) Inventor: Christian Francesconi, Kapfenberg (AT)

( * ) Notice: Subject to any disclaimer, the term of this patent is extended or adjusted under 35 U.S.C. 154(b) by 0 days.

(21) Appl. No.: 12/740,702

(22) PCT Filed: Oct. 24, 2008

(86) PCT No.: PCT/AT2008/000389

§ 371 (c)(1),
(2), (4) Date: Jan. 3, 2011

(87) PCT Pub. No.: WO2009/059339

PCT Pub. Date: May 14, 2009

(65) Prior Publication Data

US 2011/0089803 A1 Apr. 21, 2011

(30) Foreign Application Priority Data

Nov. 5, 2007 (AT) ..... A 1775/2007

(51) Int. Cl.
*H01T 13/00* (2006.01)
*H01T 13/20* (2006.01)

(52) U.S. Cl. ..... 313/118; 313/11.5; 313/141; 313/143

(58) Field of Classification Search ..... None
See application file for complete search history.

(56) References Cited

U.S. PATENT DOCUMENTS 2,776,394 A 1/1957 Cuny et al.
6,992,426 B2 * 1/2006 Francesconi et al. ..... 313/144
7,105,991 B2 * 9/2006 Egger et al. ..... 313/143
7,408,293 B2 * 8/2008 Francesconi et al. ..... 313/143
7,615,914 B2 * 11/2009 Francesconi et al. ..... 313/140
2002/0180326 A1 12/2002 Francesconi et al.

FOREIGN PATENT DOCUMENTS

EP 1265329 A1 12/2002
JP 2007035570 A 2/2007

* cited by examiner

*Primary Examiner* — Natalie Walford
(74) *Attorney, Agent, or Firm* — Laurence A. Greenberg; Werner H. Stemer; Ralph E. Locher

(57) ABSTRACT

The invention relates to a spark plug of an internal combustion engine, especially for use in Otto gas engines. Said spark plug comprises, supported by an insulating body (1), a preferably one-piece spark plug shell (2) and a center electrode (3), which is especially rod-shaped or has a plurality of electrode fingers, and at least one ground electrode (4), preferably a plurality of ground electrodes, the center electrode (3) and the at least one ground electrode (4) being surrounded by a chamber, especially a pre-chamber (5*a*) or a swirl chamber (5*b*) supported by the spark plug shell (2), or being located inside said chamber (5*a*, 5*b*). The invention is characterized in that the ground electrode(s) (4) has/have a support (6) secured to the spark plug shell (2) or arranged thereon as the base, or branch(es) off therefrom, and in that said ground electrode support (6) and every finger-type ground electrode (4) branching off therefrom is arranged at a distance (21) from the inner wall surface (7) of the chamber (5*a*, 5*b*).

25 Claims, 8 Drawing Sheets swirl chamber

FIG. 12
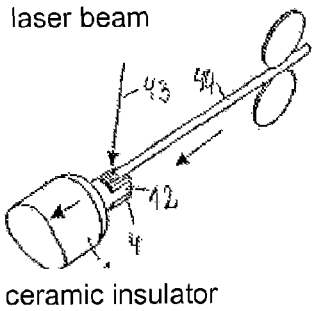
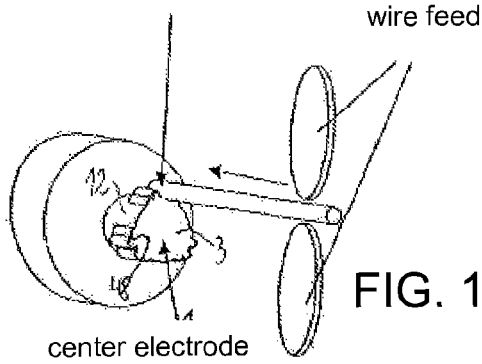
FIG. 13
FIG. 14A
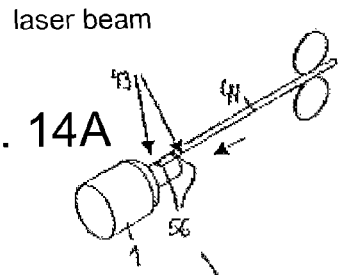
FIG. 14B
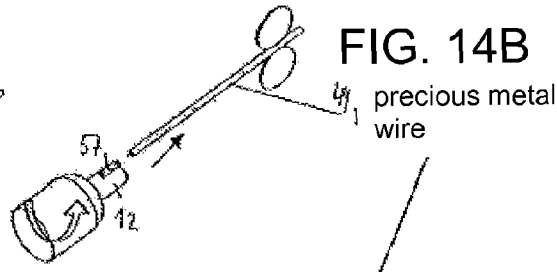
FIG. 14C
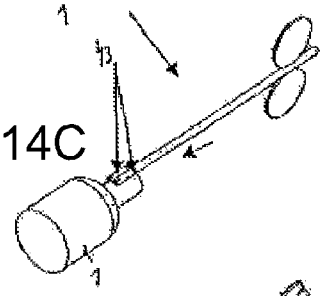
FIG. 14D
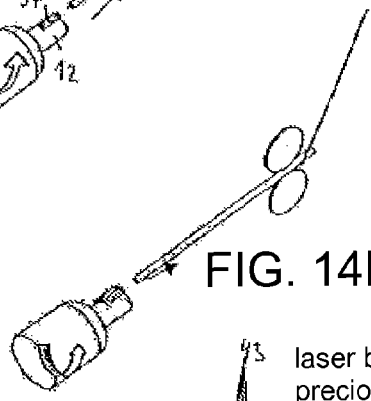
FIG. 14E
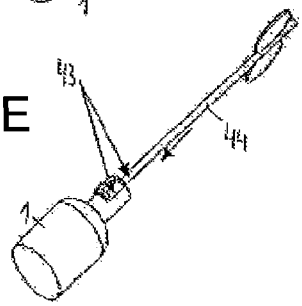
FIG. 14F
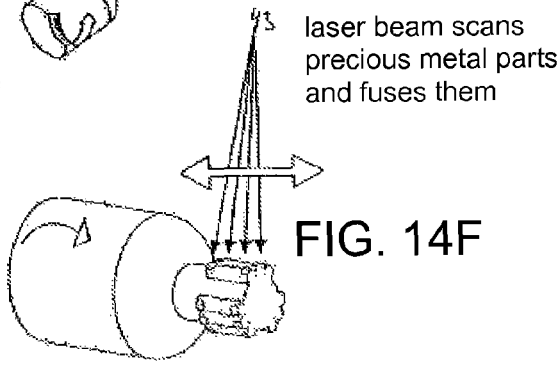

SPARK PLUG COMPRISING A GROUND ELECTRODE SUPPORT

BACKGROUND OF THE INVENTION

Field of the Invention

The invention relates to a spark plug for an internal combustion engine, especially for use in an Otto-cycle gasoline engine, having a spark plug shell, preferably one-piece, supported by an insulating body, and a rod-shaped or multi-fingered center electrode and at least one ground electrode; with the center electrode and the at least one ground electrode encased by a chamber supported by a spark plug shell, especially a pre-chamber or swirl chamber, or placed within this chamber; with a wall part of the swirl chamber open on the combustion chamber side, close to the shell, or a wall part of the pre-chamber that surrounds the at least one ground electrode close to the shell, possessing a circular-ring-shaped cross section or being formed from a cylindrical ring; with the at least one ground electrode having a support attached as a base on the spark plug shell or situated on it, and extending from this support; and with this ground electrode support and each finger-shaped ground electrode extending from it placed at an interval from the inner wall surface of the chamber.

Such spark plugs are known from the state of the art.

The goal of the invention is to simplify manufacture of such spark plugs, especially in regard to avoiding complex components that are difficult to manufacture, and that the spark plug is assembled from easy-to-produce parts. This is particularly important for mass production. In addition the electrical properties of such spark plugs should at least match those of comparable spark plugs, if not improve on them. Accordingly, care is to be taken for an optimal current feed to the individual ground electrodes. In addition, an invention-specific spark plug should permit being configured as a pre-chamber spark plug or as a swirl chamber spark plug. Lastly, the ignition properties and the thermal conductivity of the initiating electrodes should be optimized to achieve better thermal corrosion resistance.

These goals are attained by a spark plug as claimed, in that the ground electrode support has a circular-ring-shaped cross section viewed perpendicular to the longitudinal axis of the spark plug, or is formed by a cylindrical ring; that on the spark plug shell two concentrically placed, cylindrical end protections are configured, of which if necessary the inner end projection extends above the outer end projection in the direction of the combustion chamber; and that on the inner end projection, the ground electrode support, and on the outer end projection, the wall part of the chamber, is set, placed, or screwed and/or attached if necessary via spot or seam welding.

Placement of the ground electrodes on a separate support ensures uniform current feeding to the ground electrodes, without any current diversion such as via a pre-chamber or swirl chamber standing in direct contact with the ground electrodes. Since the ground electrode support is situated at a distance from the inner wall surface of the chamber, i.e. a pre-chamber or a swirl chamber, the ground electrodes and their supports represent a system independent of the wall part of the chamber. This makes it easy to readjust the electrodes and thus the electrode erosion due to use can be corrected. Owing to it being possible to produce the support and the ground electrodes especially as a one-piece component, there are considerable manufacturing advantages. Additionally, due to the fact that the ground electrodes can be produced as a one-piece component, and that there is an interval between the ground electrode support and the inner wall of the pre-chamber or swirl chamber, thermal conductivity is improved from the initiating electrodes to the spark plug shell. The special form of the ground electrodes and the type and manner of applying a precious metal alloy yields further advantages in regard to improved ignition performance.

The spark plugs are especially easy to produce with stable assembly owing to the special form of the ground electrode support. The ground electrode support having a cylindrical-ring-shaped cross section is adjusted in simple fashion at a circumferentially constant interval to the inner surface of the wall section of the swirl or pre-chamber, resulting in defined relationships as regards combustion and current conduction. In addition, the spark plugs are simpler to assemble and install, since the cylindrical-ring-shaped ground electrode support and also a swirl chamber or a pre-chamber having a cylindrical ring shape cross section can easily be placed on the spark plug shell and attached there. On its inner wall surface, the ground electrode support can be configured with a threading or also have a smooth surface; the same holds true for a swirl chamber or a pre-chamber. Either the ground electrode support or the swirl chamber or the pre-chamber is screwed onto the projecting shoulders of the spark plug shell and perhaps secured in their position by welding, or these components are slid with the most exact possible seating onto the spark plug shell and attached in their position, especially by fusing.

The features according to which the at least one ground electrode and its support are configured as one piece or joined to each other by welding yield a simply assembled ground electrode.

If a metallic or ceramic cylindrical ring is placed between the wall part of a pre-chamber or a swirl chamber and the ground electrode support, the result is good heat transmission from the ground electrode support to the swirl chamber or pre-chamber. Ceramic materials make possible an electrical separation of the pre- or swirl chamber and the ground electrode support while simultaneously providing good thermal conduction from the ground electrode support via the cylindrical ring and the pre- or swirl chamber to the spark plug shell. In addition, a spark plug assembled in this manner can be manufactured simply. First the ground electrode support is positioned or welded into place on its shoulder. Thereupon the cylindrical ring is slid over the ground electrode support. Thereupon the chamber with its cylindrical wall part is placed on the provided shoulder of the spark plug shell, i.e. slid or screwed on and/or attached by welding. On the inner wall surface of the pre-chamber or swirl chamber, at least one nose can be formed, which secures the cylindrical ring in its position. In operation it is advantageous if the ground electrode support, the cylindrical ring and the pre-chamber or swirl chamber adjoin each other, to ensure good heat transfer and/or good current conduction.

The features according to which an end wall, preferably planar or cupola-shaped, is supported by the cylindrical wall part of pre-chamber, which delimits or partitions the inner area of pre-chamber or is configured as one piece with the wall part, having through-passage recesses to permit ignited gas jets to pass through being configured in the wall part and/or in the end wall offer advantages in regard to the function of the spark plug. The features that in the wall part of the chamber at least one rinsing recess or opening, preferably having a circular cross section, for passage of the fuel-air mixture and/or a slit-shaped recess to expose at least of the combustion-chamber-side end areas of the finger-shaped ground electrodes are placed opposite the particular end area, contribute to better combustion and good thermal dissipation.

It is advantageous if one, three or five ground electrodes are carried by the ground electrode support and/or if the ground electrodes are placed on the ground electrode support at equal intervals to each other, distributed about the center electrode, and/or if each of the finger-shaped ground electrodes projecting out from the ground electrode support have a rectangular or cylindrical-ring-section cross section that is transverse to its longitudinal extension at least in partial segments. The ground electrode supports are easy to produce and yield good erosion qualities. It contributes to the combustion performance of the spark plugs if the at least one or each of the ground electrode(s) extends from the support in the form of a finger and its end area on the combustion chamber side extends parallel to the longitudinal axis and/or to the facing surface area of the center electrode and/or if the spark gap is formed between surface areas of the ground electrode and the center electrode that are opposite each other and extend parallel to the longitudinal axis.

The invention-specific spark plugs are simply constructed and speedily assembled with the appropriate tolerances able to be well maintained, if provision is made for configuring an outer thread lying on the concentrically placed end shoulders and an inner thread lying on the inner surface of the wall part of the chamber and adapted to the particular outer thread, and/or that the ground electrode support and the cylindrical-ring-shaped wall part of the chamber are concentrically placed to each other while forming the pre-set interval and/or that the cylindrical wall part and the support are pushed onto the particular shoulder and there attached by welding. The spark plug shell can be manufactured to the requisite exactness without too great an expense. By appropriately precise manufacture of the ground electrode support and the pre-chamber or the swirl chamber, the intervals between ground electrode support and pre-chamber or swirl chamber can be maintained precisely over the entire circumference of the spark plug.

Regarding the ignition properties and thermal behavior of the spark plug, it is advantageous that the interval between the outer surface of the ground electrode support and the wall part of the chamber is smaller than the thickness of the wall part of the chamber and/or that the thickness of the ground electrode support is three to fifteen times, preferably five to ten times, the thickness of the spark gap and/or that the interval between the outer wall surface of the ground electrode support and the inner wall surface of the chamber is 50 to 200% of the thickness of the spark gap. Good erosion properties result if provision is made that precious metal alloys or at least a platelet made of precious metal alloys is applied or fused or welded in the circumferential areas or on locally limited elevations or on radial surface areas pointing outward of the center electrode and/or on the surface of the particular finger-shaped ground electrode facing the center electrode, or on elevations configured on this surface, in strips that lie next to each other and if necessary one atop the other.

A contribution to good thermal conduction is made if provision is made that the center electrode is configured in the shape of a compact component or as a hot-plate-shaped component filled with a material having high thermal conductivity and if necessary is slid on the base center electrode and is welded to it in one place or in multiple places about the circumference.

An improvement in the ignition characteristics of the spark plugs and a re-set capability of the ground electrodes relative to the center electrode is made possible by the features that the end of the wall part of a swirl chamber on the combustion chamber side projects over the side of the center electrode on the combustion chamber side and/or that, in the wall part of the chamber, opposite each ground electrode, a slot is configured that extends parallel to the ground electrode, if necessary open to the end of the wall part on the combustion chamber side, which provides access to the end area of the ground electrode.

A contribution is made to the ignition properties as well as the flow transport and thermal dissipation and the corrosion resistance of the spark plugs, if the wall part of the chamber and the support are electrical conductors, and are connected so as to conduct electricity with the spark plug shell and/or if each finger-shaped ground electrode is bent from its support in the direction toward the center electrode and after a further bend, runs in a direction roughly parallel to the center electrode, and/or if the wall part of the chamber, the sheathing and/or the at least one ground electrode with its support is manufactured from a nickel-based alloy and/or a high-temperature steel and/or hot-corrosion-resistant metal alloys with good thermal conductivity capabilities, and/or that the pre-chamber is manufactured from brass.

A spark plug shape optimized in regard to the erosion properties and ignition precision is achieved if provision is made that the wall part of the chamber and the support are electrical conductors, and are connected with the spark plug shell so as to conduct electricity, and/or if each finger-shaped ground electrode is bent from its support in the direction toward the center electrode and after a further bend, runs in a direction roughly parallel to the center electrode, and/or if the wall part of the chamber, the sheathing and/or the at least one ground electrode with its support is manufactured from a nickel-based alloy and/or a high-temperature steel and/or hot-corrosion-resistant metal alloys with good thermal conductivity capabilities, and/or that the pre-chamber is manufactured from brass.

Preferred embodiment forms of the invention can be gleaned from the following description, the drawings and the patent claims.

BRIEF DESCRIPTION OF THE SEVERAL VIEWS OF THE DRAWING

FIGS. 8, 9, 12, 13 and 14*a* to *f* schematically show the application of a precious metal alloy onto appropriate surface areas of a ground electrode or a center electrode.

DESCRIPTION OF THE INVENTION

Figure 1:
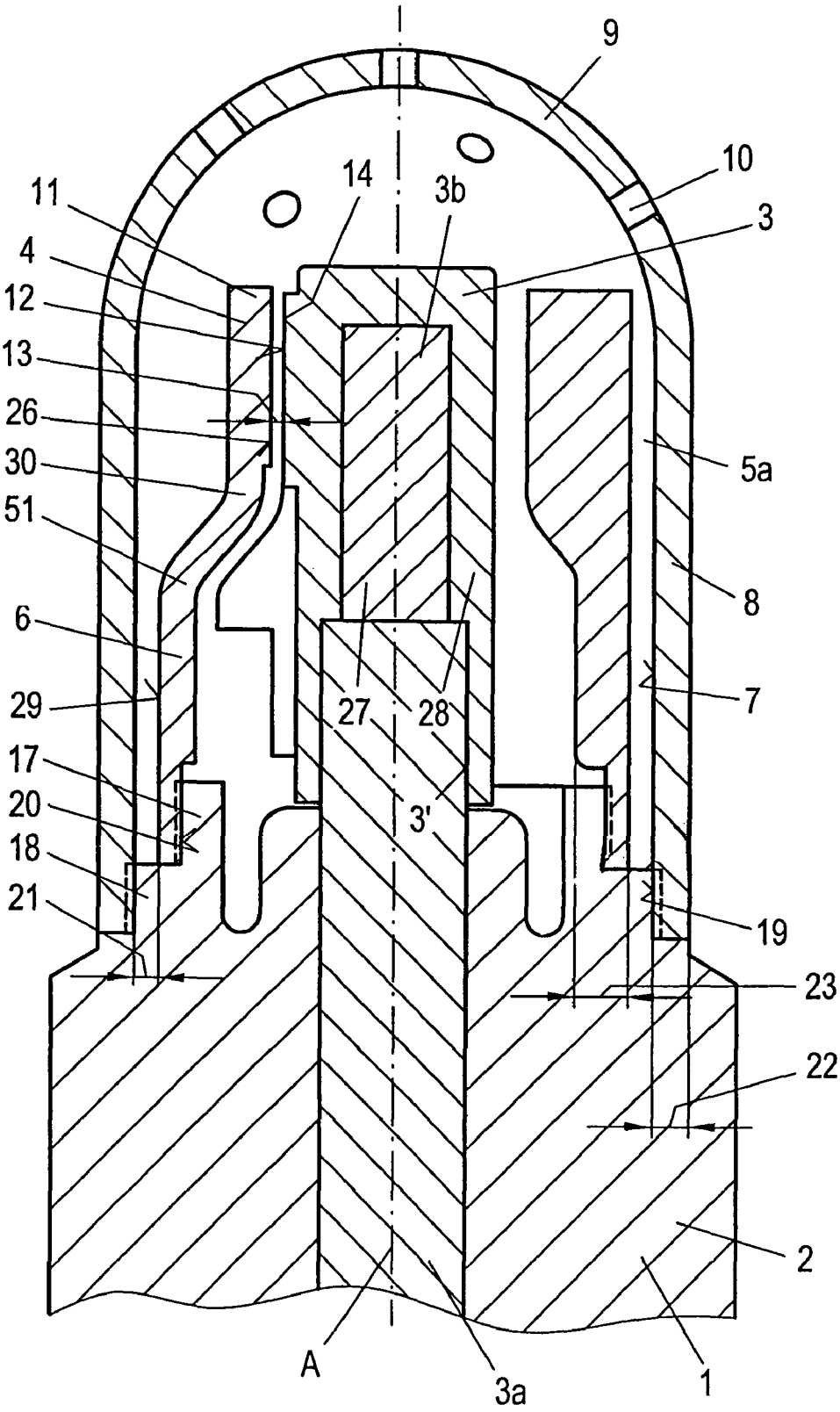
FIG. 1 shows a schematic longitudinal section through an embodiment form of an invention-specific spark plug.

FIG. 1 shows a spark plug for use in an internal combustion engine, especially for use in an Otto-cycle gasoline engine. A spark plug shell 2 is supported by an insulating body 1, with a center electrode base 3*a* surrounded by or projecting from insulating body 1. The center electrode 3 is placed on this center electrode base 3*a* of the spark plug. This center electrode 3 can be formed from a single pin-like component. Provision can be made that, as in the present instance, the center electrode 3 is filled with a material 3*b* having high thermal conductivity, to make possible better thermal conduction from the electrode surfaces 12 to center electrode base 3*a*. The end of center electrode 3 on the combustion chamber side can be formed from a hot plate 28, which is attached on the center electrode base 3*a*, especially via welding multiple times about the circumference, advantageously in area 3*a*. By this means, thermal dissipation is further improved.

For formation of at least one spark gap, over the circumference of center electrode 3 at least one ground electrode 4 is situated. Preferably one, three or five ground electrode(s) 4 are carried by one ground electrode support 6 or project from it, with the ground electrodes 4 in appropriate fashion being situated on ground electrode support 6, distributed at equal intervals from each other about center electrode 3. The ground electrode support 6 is supported by spark plug shell 2 or is attached to it or projects from it.

As is evident from FIG. 1, the at least one ground electrode 4 projects in the form of a finger from support 6, or finger-like ground electrodes 4 can be attached or welded on support 6. The fingers 4 and support 6 can also be designed as a one-piece component. The end area 11 on the combustion chamber side of the fingers extends parallel to longitudinal axis A of the spark plug and to the facing surface area 12 of center electrode 3. The spark gap 13 is placed between surface areas 26, 12 opposite each other of ground electrode 4 and center electrode 3.

For attachment of support 6 on spark plug shell 2, provision is made that spark plug shell 2 has two cylindrical, concentrically placed end projections 17, 18, of which inner end projection 17 extends above outer end projection 18 in the direction of the combustion chamber. On inner end projection 17, support 6 of the ground electrodes 4, and on outer end projection 18, the wall part 8 of the particular chambers 5*a* or 5*b* is placed, stuck or screwed on, and especially connected by point- or seam-shaped welds. The inner dimensions of wall part 8 and of the ground electrode support 6 are adapted to the particular outer dimension of end projections 17 to 18.

By this means the support 6 can be simply and exactly attached to spark plug shell 2, and it is possible to replace the ground electrodes 4 in the course of servicing.

The support 6 or a chamber 5*a* or 5*b* can be simply installed, if an outer thread is formed on the concentrically placed end projections 17, 18 that have a circular circumference, and an inner thread that is adapted to the particular outer thread is formed on the inner wall surface 19 of wall part 8 of the particular chambers 5*a*, 5*b*. Heat conduction from the electrodes 4 to spark plug shell 2 is improved if the support 6 is screwed or welded onto the end projection 18 or screwed or placed on and then welded on or connected with end projection 18 by multiple encircling welds.

Ground electrode support 6 and especially also section 41 of each ground electrode 4 extending in finger fashion from support 6 are placed at an interval 21 from inner wall surface 7 of chamber 5*a* or 5*b*. This interval is pre-set to ensure a defined and independent current flow in the ground electrode support 6 and to permit screwing the chambers 5*a* or 5*b* or their wall part 8 independent of the ground electrode support 6 onto spark plug shell 2 or to be able to remove them from them. Additionally, as already mentioned above, owing to interval 21, the heat can be dissipated in independent and defined fashion from the electrodes 4 to spark plug shell 2.

Figure 10:
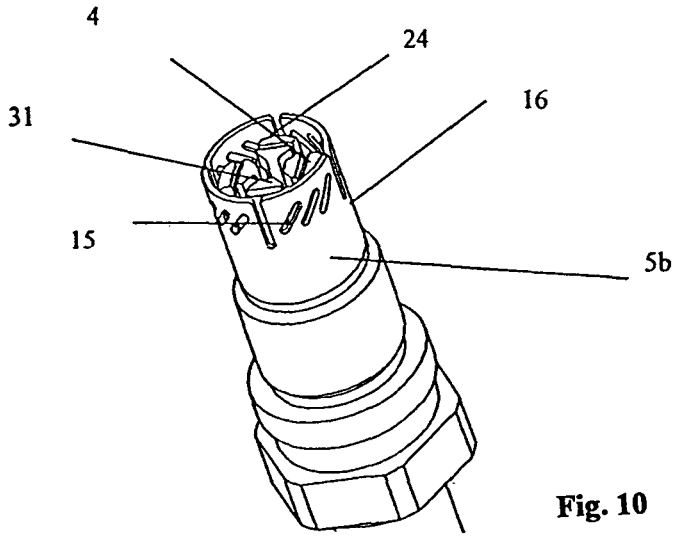
Figure 11:
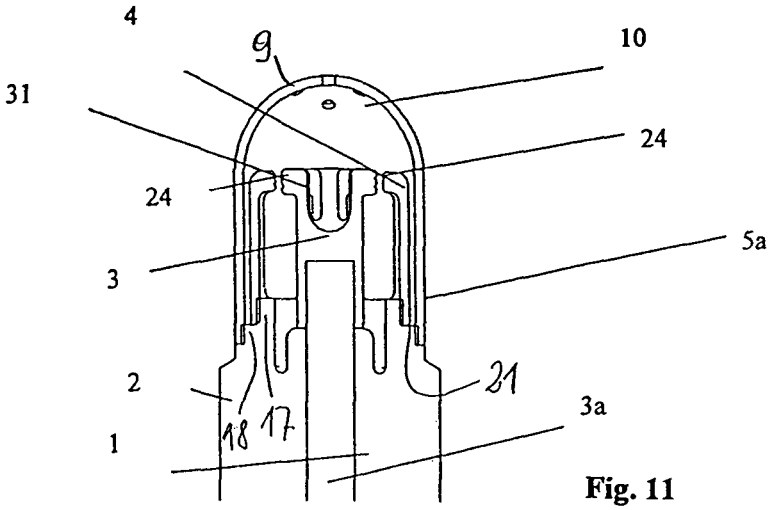
Figure 7:
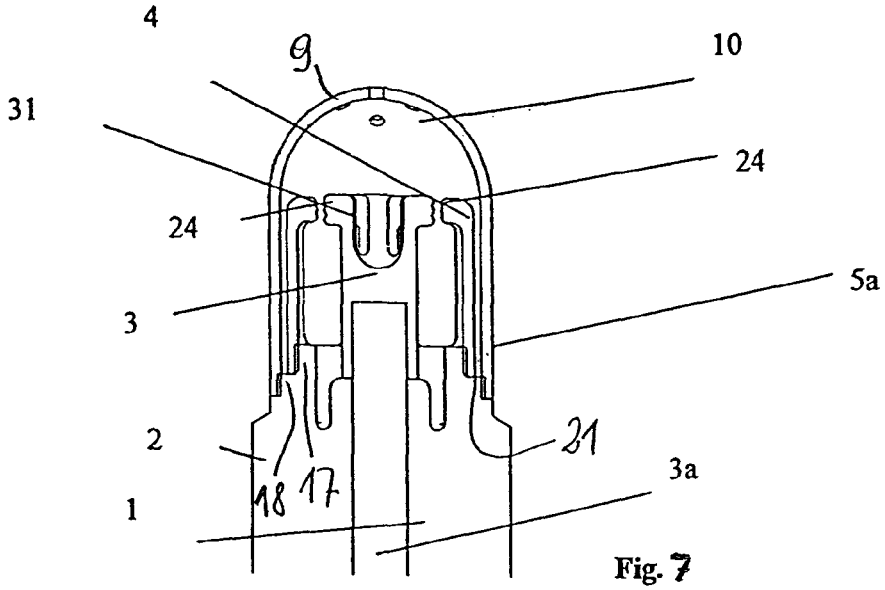

FIGS. 1 and 11 depict a spark plug with a chamber that is configured as a pre-chamber 5*a* and which thus surrounds the ground electrodes 4 and the center electrode 3 on the circumferential side and combustion chamber side, i.e. on all sides. FIGS. 4, 5, 6 and 10 depict a spark plug with a swirl chamber 5*b*, which surrounds ground electrodes 4 and the center electrode 3 only on the circumference. The invention-specific spark plug can have a pre-chamber 5*a* or a swirl chamber 5*b*. Mixed types or variations on such chambers can also be provided.

The design and manufacture of the corresponding parts are simplified if, as depicted in FIGS. 1, 4, 5, 6, 10 and 11, the wall part 8 of swirl chamber 5*b* that is open on the combustion chamber side or the wall part 8 of pre-chamber 5*a* surrounding center electrode 3 and ground electrode 4 and the ground electrode support 6 have circular-ring-shaped cross sections or are each formed from a cylindrical ring.

With a pre-chamber spark plug as it is depicted in FIG. 1, it is advantageous if an end wall 9, preferably planar or cupola-shaped, is supported that delimits or partitions the inner area of pre-chamber 5*a* from cylindrical wall part 8 of pre-chamber 5*a*, or is configured as one piece with wall part 8, advantageously with through-passage recesses 10 for permitting ignited gas jets to pass through being configured in wall part 8 and/or in the end wall 9.

To improve ignition properties, provision can be made that the overall surface of the through-passage recesses 10 in the end wall 9 of pre-chamber 5*a* amounts to 1 to 3%, preferably 1.5 to 2.5%, of the surface of end wall 9.

Simple manufacture and the ignition properties are supported if support 6 and cylindrical-ring-shaped wall part 8 of the particular chambers 5*a*, 5*b* are placed concentric to each other while forming a pre-set interval 21.

The interval 21 between support 6 and wall part 8 of the particular chambers 5*a*, 5*b* is advantageously less than the thickness 22 of wall part 8 of chambers 5*a*, 5*b*. The thickness 23 of support 6 can be three to fifteen times, preferably five to ten times, that of spark gap 13.

The interval between outer wall surface 29 of support 6 and inner wall surface 7 of chamber 5*a* or 5*b* advantageously is 50 to 200% of the thickness of spark gap 13. The features mentioned previously have a positive influence on ignition and thermal conduction properties.

In advantageous fashion each finger-shaped ground electrode 4 is bent directly, or while forming a section 41 that continues the direction of the support wall, in the direction of center electrode 3, and has a direction approximately parallel to center electrode 3 after a further bend 30. What is achieved by this is that the base formed by ground electrode support 6 has a correspondingly greater interval from center electrode 3 than those surfaces of ground electrode 4, which limit the spark gap 13 with center electrode 3.

As is evident from FIGS. 2, 2*a*, 2*b*, 2*c*, 2*d* and 2*e* along with 4 and 5, in the circumferential areas or on the surface areas 12 of center electrode 3 that point radially outward and/or on the surface 26 facing center electrode 3 of the particular finger-shaped ground electrode 4, adjoining strips 40 made of a precious metal 24 are applied or fused on. Instead of a directly applied or fused-on precious metal strip as per FIG. 2*b*, the precious metal alloy can, as per FIGS. 2 and 2*a*, also be applied to areas 48 of the cylindrical part of center electrode 3, which perhaps are formed by welded-on or plate-shaped areas or elevations stretched on in one piece. Also on the ground electrode 4, such elevated areas 48 can be formed, which the precious metal alloys are melted onto.

For operation of the spark plugs, it has been shown to be advantageous if the ground electrode(s) 4 is or are configured with finger shapes, and the end areas 11 of the individual ground electrodes 4 placed on the combustion chamber side extend at a constant interval from the center electrode 3 in a longitudinal direction to, and/or parallel to, the surface 12 of center electrode 3 forming spark gap 13. On the end areas 11 of ground electrode(s) 4 turned toward center electrode 3, and/or on the circumferential surface areas 12 of center electrode 3 lying opposite these end areas 11, preferably only on the areas of the center electrode opposite the end areas 11 of the ground electrodes 4, precious metal alloy 24 is applied or formed, especially fused or welded on. The precious metal alloy 24 especially is formed of Ir—Rh, Pt—Rh, Ir—Pt—Rh, and is alloyed or fused on by means of a continuous-wave or, advantageously, discontinuously operated laser onto the particular surface.

The wall part 8 of chambers 5*a*, 5*b*, the sheathing 28 of center electrode 3, and/or the at least one ground electrode 4 with its support 6 are manufactured from a nickel-based alloy and/or high-temperature high-grade steel and/or metal alloys that can resist hot corrosion and have good thermal conduction properties; the pre-chamber 5*a* also can be made of brass.

For stable operation of such a spark plug, it has proven to be advantageous if the precious metal alloy 24 is applied in strips that adjoin, and if necessary overlap or run compact or merge into each other with their lateral areas, parallel to or transverse to the longitudinal extension of center electrode 3 to the surfaces of center electrode 3 bordering spark gap 3 and/or to the end areas 11 of the individual ground electrodes 4.

Figure 3:
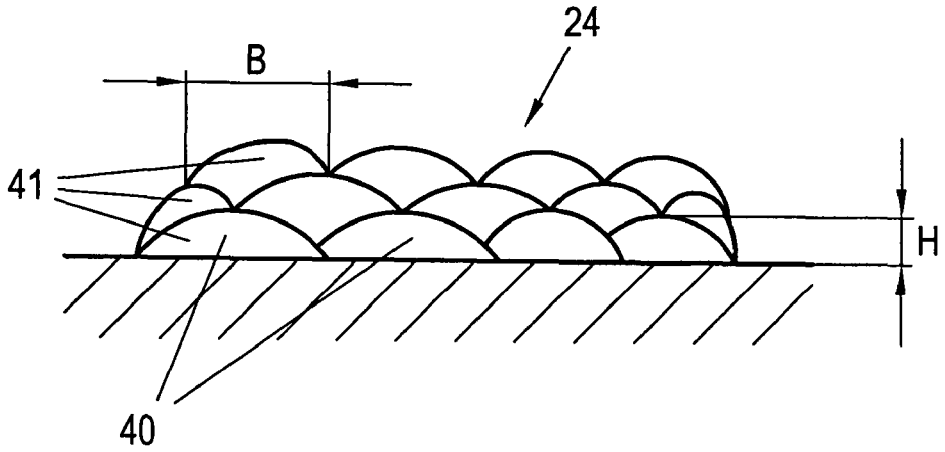
FIG. 3 shows an applied precious metal alloy.

In advantageous fashion, the precious metal is deposited, or the strips are formed, in the axial direction of the spark plugs or parallel to the longitudinal direction of center electrode 3. It can be advantageous if the precious metal alloy 24 is applied, especially in adjoining strips 40, in multiple layers 41 lying one above the other, to create appropriate layer thicknesses. It is also possible to fuse the precious metal alloy 24 in scale-like strips and/or apply it in strips lying next to each other and/or one atop the other, as FIG. 3 shows in cross section.

Great solidity is achieved if the precious metal alloy 24 is configured or applied by fusing or welding of platinum and/or iridium and/or Pt—Rh and/or Ir—Rh, or smelted with surface area(s) of center electrode 3 and/or end area(s) 11 of the particular ground electrode(s) 4. Instead of precious metal alloy strips 40, electrode platelets consisting of precious metal alloys can be applied, and especially welded, onto the raised areas 48 of center electrode 3 and/or on the end surface areas 11 of the particular ground electrode(s) 4 that face center electrode 3 (FIGS. 2*c*, 2*d*, 2*e*).

It has been shown to be advantageous for manufacture and operation of the spark plugs if the number of finger-shaped ground electrodes 4 is uneven, or that the ground electrodes 4 do not lie opposite each other relative to the central axis A of center electrode 3. This it is easily possible to apply precious metal alloys 24 to the ground electrodes 4 projecting from support 6.

Especially in this case it is easily possible to manufacture such ground electrodes, if they are already attached to ground electrode support 6 or exist as a single piece with them, since with appropriate application tools, i.e., laser welding devices, and a correspondingly inputted precious metal alloy wire, access is easily found to the surfaces areas to be coated with precious metal alloy 24.

The surface of ground electrode 4 facing center electrode 3 and/or its precious metal alloy 24 can be adapted to the surface contour of center electrode 3 or the precious metal alloy 24 applied onto it can have a comparable curvature.

Additionally, provision can be made that a slit 16 extending parallel to ground electrode 4, and open if necessary to the end of wall part 8 on the combustion chamber side, can be made in wall part 8 of a chamber 5*a*, 5*b* opposite each ground electrode 4, which permits access to end area 11 of the particular ground electrode 4 for maintenance purposes.

Figure 4:
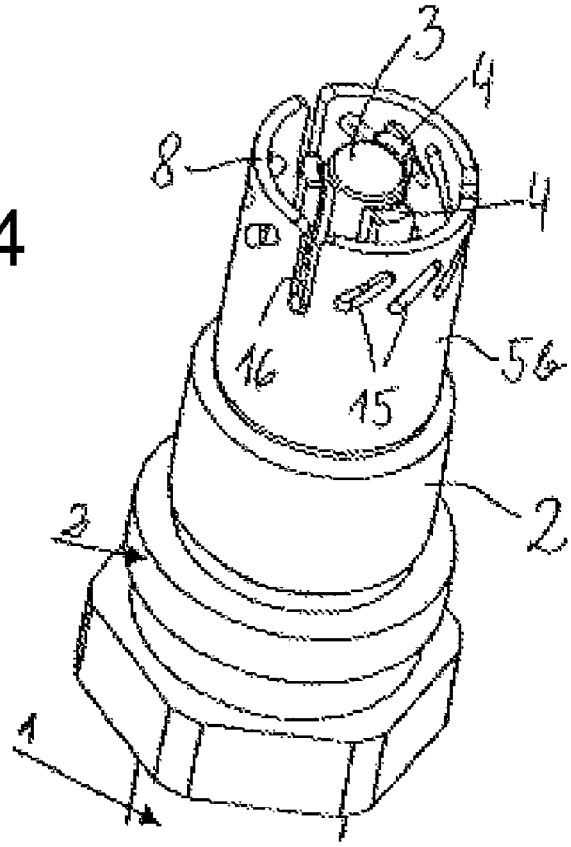
FIGS. 4 and 5 show views of an embodiment form of an invention-specific spark plug.

Good erosion properties result if, as shown in FIG. 4, the end of wall part 8 of a swirl chamber 5*b* on the combustion chamber side projects above the end of center electrode 3 on the combustion chamber end and the provided ground electrode 4.

For operation of such spark plugs, it has shown to be advantageous if the spark gap 13 or the interval between the individual ground electrodes 4 and the center electrode or the precious metal alloy 24 applied on the particular ground electrode 4 and/or on center electrode 3, is 0.1 to 1.0 mm, preferably 0.15 to 0.5 mm.

Sturdy ignition surfaces result if the precious metal alloy 24 is applied in strips 40 that especially lie next to each other, with the width B of the applied strip being 1.5 to 8 times, preferably 2 to 5 times, the height H of the applied strip 40. It is advantageous if the width B of an applied strip is a third to a tenth, preferably a fourth to an eighth, of the width of the end area 11 of a finger-shaped ground electrode 4 in the area of spark gap 13. The cross section of strip 40 can be rectangular, or correspond to the extended or longer half of an ellipsoid.

Figure 5:
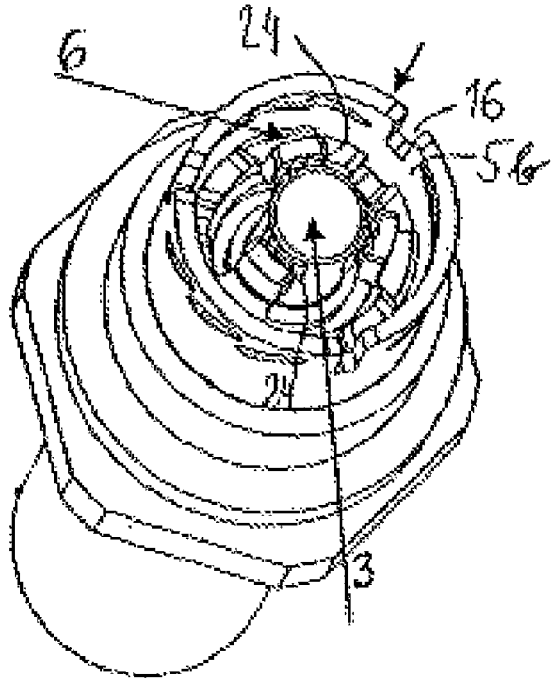

Also with embodiment forms of spark plugs as per FIGS. 4 and 5, provision is made that the finger-shaped ground electrodes 4 surrounded by a swirl chamber 5*b* are bent off from their support 6 toward center electrode 3 and that an end area 11 of finger-shaped ground electrode 4 adjoins on this bend-off section 51, which runs essentially parallel to the surface of center electrode 3 and whose surface 26 facing center electrode 3 and/or the surface 14 of the end area 11 of ground electrode 4 has the precious metal layer 24.

For operation and for the ignition behavior of the spark plugs it is advantageous, as shown in FIG. 1, if through-passage recesses 10 are formed in wall part 8 and/or in the cover wall 9 of pre-chamber 5*a*, through which fuel ignited in pre-chamber 5*a* passes out in the form of burning gas jets, with the arrangement and direction of the individual through-passage recesses 10 chosen so that a number of, and preferably all of, the gas jets emerging from pre-chamber 5*a* expand in diverging directions.

The end wall 8 and the cylindrical wall 8 of pre-chamber 5*a* can be configured as one piece or connected with each other by welding.

When the precious metal alloy 24 is applied to the corresponding surfaces of the spark plugs, a procedure can be used such as is depicted schematically in FIGS. 8, 9 and 12 to 14. In principle provision is made that precious metal alloy 24 is fused and/or welded on to the surfaces 26 of the end areas 11 of ground electrodes 4 on the side of the combustion chamber, and/or onto the center electrode 3, especially on its surface areas 12 that are directed radially and lie on the combustion chamber side, if necessary in multiple steps. For this a wire or rod 44 made of precious metal alloy 24 is brought close to the particular surface 12, 26 and moved either parallel or transverse relative to the particular longitudinal extension of the finger of ground electrode 4 or the surface or axis of center electrode 3, and welded or fused with the material of finger 4 or of center electrode 3 or securely attached with already applied precious metal alloy.

A pulsed laser beam 43 is used according to the invention without exception to perform the welding or fusing.

Figure 8:
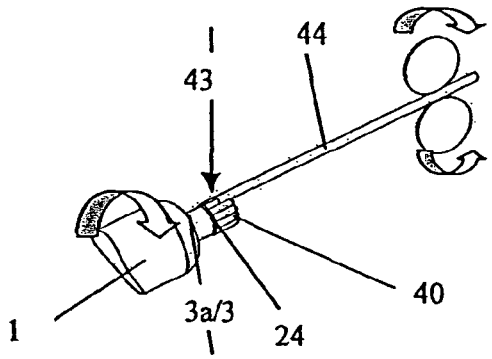

FIG. 8 is a schematic depiction of the application of precious metal alloy 24 in strips 40 that run parallel to longitudinal axis A of center electrode 3. In the same way, the precious metal alloy can be applied in strips onto surface 26 of end area 11 of ground electrode 4. When precious metal alloy 24 is applied, the rod or wire 44 and the surface 12 or 26 move relative to each other.

Figure 9:
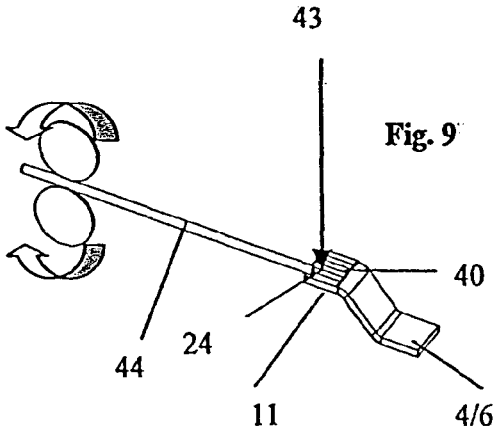

FIG. 9 shows the application of precious metal alloy 24 to the end area 11 of a finger-shaped ground electrode 4 transverse to the longitudinal extension of ground electrode 4. Advantageously, this ground electrode 4 is joined with ground electrode support 6 or configured as one piece with it when precious metal alloy 24 is being applied.

As shown in FIG. 3, precious metal alloy 24 can be deposited or applied or deposited or applied in layers 41 lying one atop the other in strips 40 lying next to each other or limited local elongated areas. Depending on the desired composition of precious metal alloy 24, the perhaps differing precious metal alloys 24 that are applied in successive application steps can, if necessary, be mixed or alloyed with each other or with the surface material.

FIGS. 12 and 13 show the application of precious metal alloy 24 to elevations 48 that are situated on a center electrode 3, especially ones designed to be a single piece with it. Such elevations are visible from FIGS. 2 and 2*a* to 2*e*. The precious metal alloy 24 is in turn fused on in the course of a relative motion of between center electrode 3 and the rod or wire 44 by means of a laser beam 43.

In a further embodiment form of the invention, the wire or rod 44 made of precious metal alloy 24 is positioned as per FIG. 14*a* on the area of electrode 3 to be alloyed, and thereafter secured on the front and rear end by means of a melt point 56. In the same way, a precious metal alloy can be applied to the surfaces 26 of ground electrode 4. In an additional manufacturing step as per FIG. 14*f*, the secured wire piece 57 can be fused onto surface 12 or attached to it. According to FIGS. 14*a* to 14*e*, multiple wire sections 57 can be attached next to each other, and only as the final step are the entire precious metal wire pieces melted with the surface of center electrode 3 or the surface of end area 11 of ground electrode support fingers 4, or applied to these surfaces.

Figure 6:
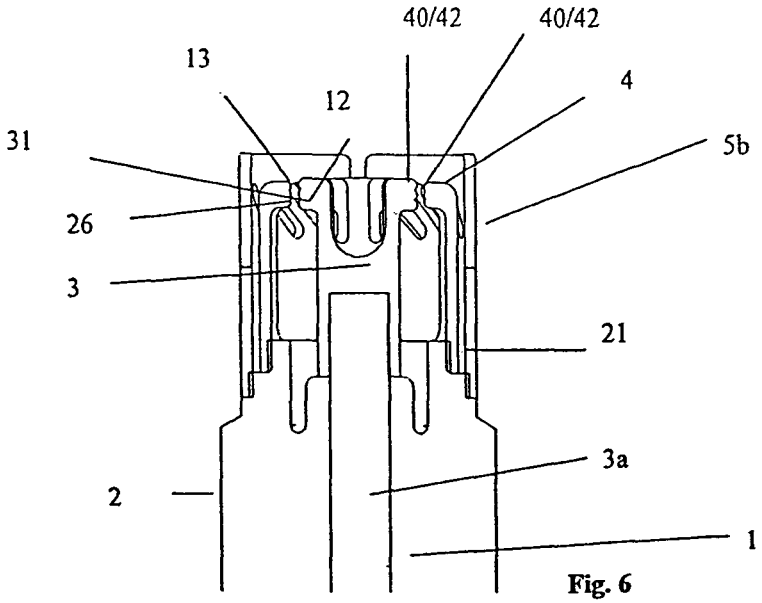
FIGS. 6, 7, 10 and 11 show embodiment forms of an invention-specific spark plug.

FIGS. 6, 10 and 11 show an embodiment form of an invention-specific spark plug in which the center electrode 3 has a multiplicity of fingers 31 that essentially run parallel to each other and are identically configured, each of which has a finger-shaped ground electrode 4 lying opposite it. The surfaces 26 of finger 31 of center electrode 3 that face each other and act as limits to spark gap 13, and the finger-shaped ground electrodes 4 support strips 40 made of precious metal alloy 24 that are fused adjacent to each other. The surfaces 12, 26 facing each other of the individual finger-shaped center electrodes 3 and the finger-shaped ground electrodes 4 with the correspondingly applied precious metal alloys 24 limit the particular spark gap 13. With this embodiment form also, the individual finger-shaped ground electrodes 4 are situated on a ground electrode support 6 which is placed at an interval 18 from the inner surface of the wall part 8 of a pre-chamber 5*a* or of a swirl chamber 5*b* that surrounds this ground electrode support 4.

The strips 40 of precious metal alloy 24 on center electrode 3 or on ground electrode 4 lie parallel to each other. The strips 40 on center electrode 3 run parallel relative to the strips 40 on ground electrode 4.

Ground electrode support 6 and wall part 8 of chambers 5*a*, 5*b* are linked with spark plug shell 2 so as to conduct electricity. Center electrode 3 is weld-connected with center electrode base 3*a* of the spark plug; this center electrode base 3*a* is guided into insulator body 1 and electrically insulated toward the shell by the insulator body.

The shape, number and size of through-passage openings 10 or rinsing openings 15 in wall part 8 is adapted to the purpose of use.

As can be gleaned from FIG. 11, cover wall 9 of pre-chamber 5*a* is advantageously designed as a single piece with wall part 8. FIG. 4 shows a spark plug with a swirl chamber 5*b*.

FIG. 1 depicts the finger-shaped ground electrodes as configured as a single piece with support 6; however, it is readily possible to weld ground electrodes 4 onto support 6.

FIG. 3 shows the application of a precious metal alloy 24 in the form of laterally overlapping strips 40 that lie next to each other, with the individual strips also being able to applied in the form of layers 41 that lie one atop the other. The relationship of the width B and height H of individual strips depends on the selected alloy material and the base material.

Figure 2:
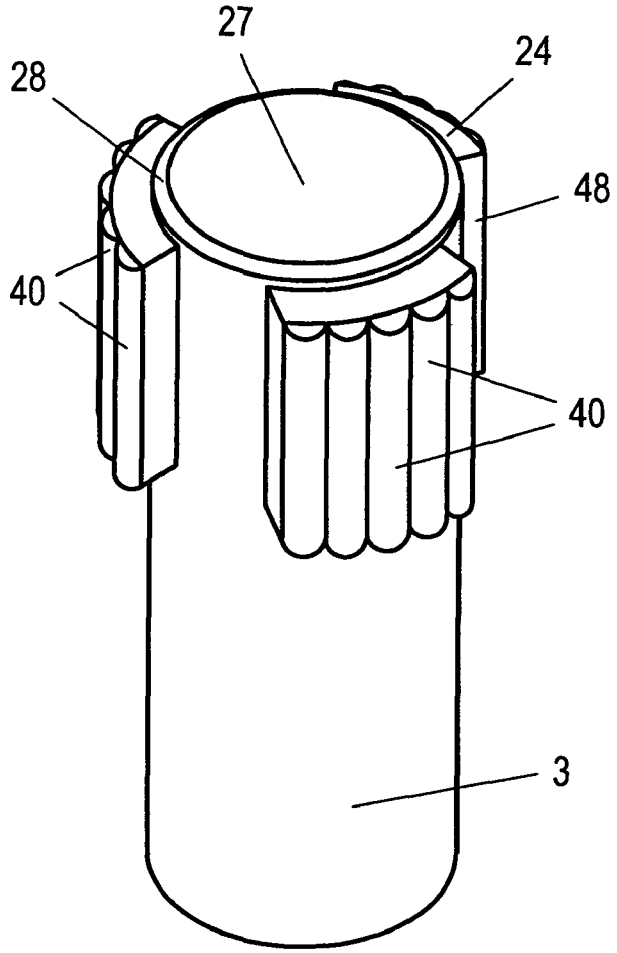
FIGS. 2, 2*a*, 2*b*, 2*c*, 2*d* and 2*e* show embodiment forms of a center electrode.
Figure 2A:
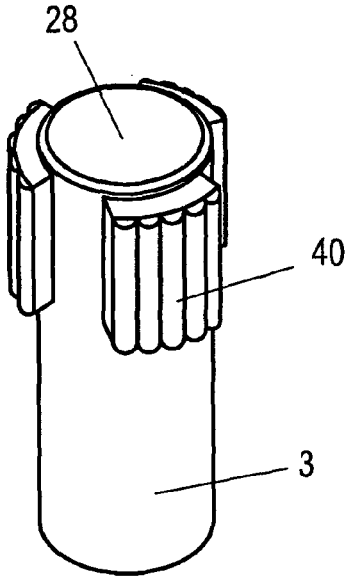
Figure 2D:
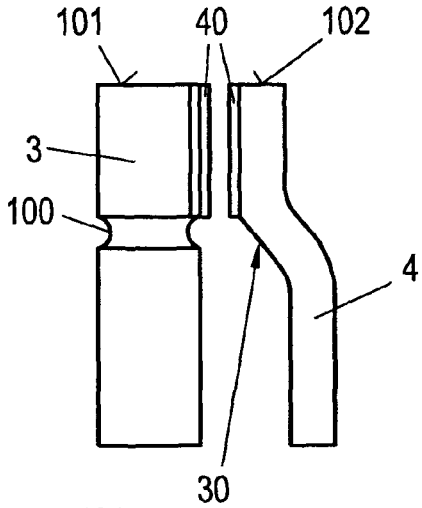
Figure 2B:
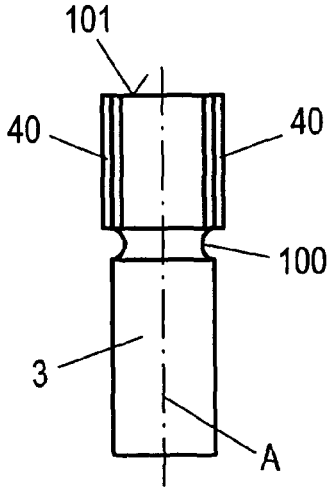
Figure 2C:
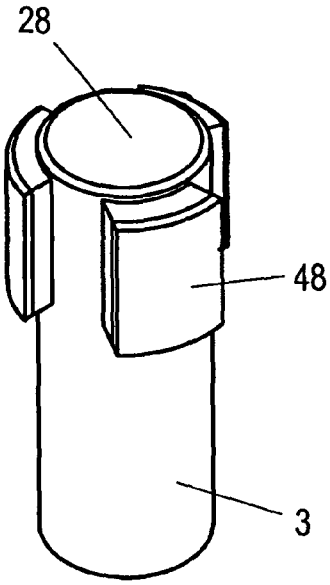
Figure 2E:
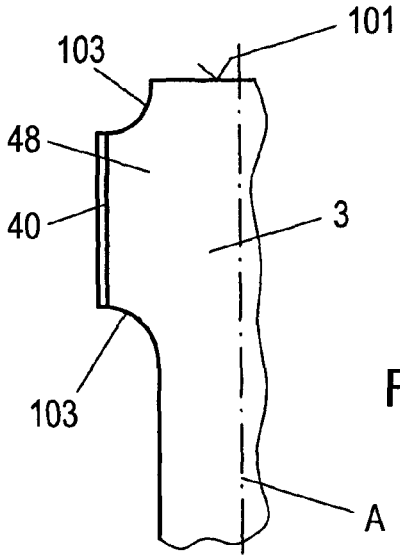

FIG. 2 shows an enlarged view of a center electrode 3, which is assembled from an electrode inner part 27 and a cylindrical sheath 28 that surrounds this electrode inner part, on which elevations 48 are formed. The inner part of the electrode can advantageously be designed from material 3*b* that is a good thermal conductor.

The surfaces 11, 26 of finger-shaped ground electrodes 4 and of center electrode 3 that lie opposite each other and limit the spark gap may be configured so that over the width and height of spark gap 13, the surfaces lying opposite each other run parallel, except for the rounded parts of the individual strips 40.

It is advantageous for the precious metal alloy layers applied to ground electrodes 4 and electrode 3 to have the same design and surface area structure. By precious metal alloy 24, not merely the alloys of the precious metals used are to be understood, but also the unalloyed metals. It is possible to apply unalloyed metals or various precious metal alloys, and to smelt an alloy during application. The unalloyed metals can be deposited or applied in non-alloyed form, and form the ignition surfaces.

The surface 26 of ground electrodes 4 that is turned toward center electrode 3 extends over a longitudinal section of ground electrode 4, as it projects from electrode support 6, to an extent from about 30 to 70%, especially 40 to 60%. Over their longitudinal extent, the ground electrodes have a cross-sectional form that remains essentially the same, especially configured in their section along surface 26. This form of ground electrode 4 especially visible from FIGS. 1, 4 and 5, makes it simple to manufacture from existing sheets or sections, and yields a defined current and thermal dissipation. This constant cross section is especially present in the section of ground electrodes 4 that is placed on the side of bend 51 that faces toward the combustion chamber.

With the special embodiment form of an invention-specific spark plug as per FIGS. 6, 10 and 11, the ground electrodes 4 are configured so that in essence they extend straight and with no bends from their support 6 in the direction of the combustion chamber and have a cross-sectional shape that remains the same in their longitudinal extension. After a bend in the end area in the direction of the provided center electrode, the bent section of ground electrode 4 terminates and forms an ignition surface 26. The finger-shaped center electrodes that lie opposite the ground electrodes have a surface 12 corresponding to surface 26 and project from a center electrode 3 placed on an electrode base 3*a*.

Figure 15:
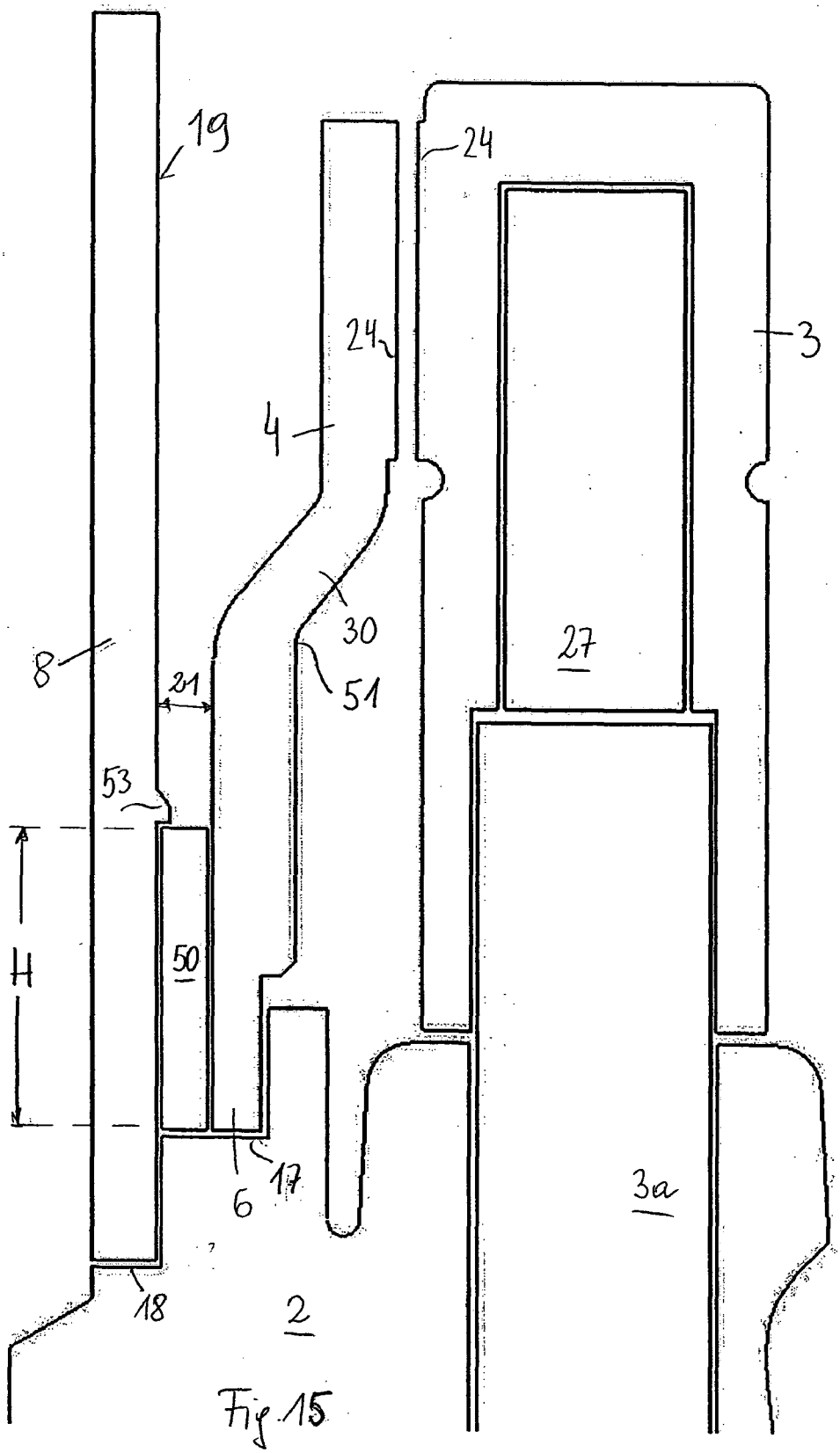
FIG. 15 shows in detail a cylindrical ring placed between a ground electrode support and the inner surface of a pre- or swirl chamber.

FIG. 15 is a view of a detail of an invention-specific spark plug. A cylindrical ring 50 is inserted in a gap 21 between ground electrode support 6 and the wall part 8 of a pre-chamber or of a swirl chamber. This cylindrical ring can be held in position by at least one nose 53 configured on the inner wall surface 19 of wall part 8, and/or be welded onto projection 17. In operation, after appropriate thermal expansion, wall part 50 is in operation with its outer surface adjoining the inner wall surface 19 of the chamber and with its inner wall surface adjoining outer wall surface 52 of ground electrode support 6. Like ground electrode support 6 on end section 17, cylindrical ring 50 stands on end projection 17, braced or supported by ground electrode support 6. Cylindrical ring 50 can be manufactured of brass. The height H of cylindrical ring 50 is 50 to 100% of the interval between end projection 17 and the bend 51 of the finger-shaped electrodes. Cylindrical ring 50 can be manufactured with advantage from metal or ceramics and thus, like brass, have a good thermal conductivity.

The invention claimed is:

1. A spark plug for an internal combustion engine, comprising:

a spark plug shell and an insulating body carrying said spark plug shell;

a center electrode and at least one ground electrode disposed on said spark plug shell;

said center electrode and said at least one ground electrode being encased by a chamber supported on said spark plug shell, and disposed within said chamber;

a wall part of said chamber having a circular-ring-shaped cross section or being formed from a cylindrical ring;

said at least one ground electrode having a support disposed on said spark plug shell and extending from said support; and said ground electrode support and each said at least one ground electrode extending therefrom being disposed at a spacing distance from an inner wall surface of said chamber;

said ground electrode support having a circular-ring-shaped cross section viewed perpendicular to a longitudinal axis of the spark plug, or being formed by a cylindrical ring;

two concentric, cylindrical end projections formed on said spark plug shell, said end projections including an inner end projection extending above an outer end projection in a direction of said chamber; and wherein said ground electrode support is placed on said inner end projection, and said wall part of said chamber is placed on said outer end projection.

2. The spark plug according to claim 1, configured for an Otto-cycle gasoline engine.

3. The spark plug according to claim 1, wherein said spark plug shell is a one-piece housing.

4. The spark plug according to claim 1, wherein said center electrode is a rod-shaped or multi-fingered center electrode.

5. The spark plug according to claim 1, wherein said chamber is formed as a pre-chamber or as a swirl chamber.

6. The spark plug according to claim 5, wherein said swirl chamber is open on a combustion chamber side, or said pre-chamber surrounds said at least one ground electrode close to the shell.

7. The spark plug according to claim 1, wherein ground electrode support and said wall part of said chamber are set, placed, or screwed, or attached on said inner end projection and on said outer end projection, respectively.

8. The spark plug according to claim 1, wherein said at least one ground electrode and the corresponding said support are integrally formed as one piece or joined to one another by welding.

9. The spark plug according to claim 1, which comprises a cylinder ring inserted between said wall part and said ground electrode support, and when the spark plug is in operation, said ring adjoining the inner wall surface of said wall part and an outer surface of said ground electrode support.

10. The spark plug according to claim 5, which comprises an end wall supported by said cylindrical wall part of said pre-chamber, said end wall delimiting an inner space of said pre-chamber or being configured as one piece with said wall part, and wherein at least one of said wall part and said end wall has through-openings formed therein to permit ignited gas jets to pass through.

11. The spark plug according to claim 10, wherein said end wall is planar or cupola-shaped.

12. The spark plug according to claim 1, wherein said ground electrode support supports a number of one, three, or five ground electrodes distributed about said center electrode equidistant and at equal intervals, wherein each of said finger-shaped ground electrodes projecting out from said ground electrode support has a rectangular or cylindrical-ring-shaped cross section transverse to a longitudinal extension at least in partial segments thereof.

13. The spark plug according to claim 12, wherein at least one, or each, of said ground electrode(s) extends from said support in the form of a finger and an end area on a combustion chamber side extends parallel to the longitudinal axis or to the facing surface area of said center electrode, and wherein a spark gap is formed between surface areas of said ground electrode and said center electrode opposite one another and extending parallel to the longitudinal axis.

14. The spark plug according to claim 1, wherein the wall part of said chamber has at least one rinsing recess or opening formed therein for passage of a fuel-air mixture and at least one recess configured to expose a combustion-chamber-side end area of said finger-shaped ground electrodes placed opposite the particular said end area.

15. The spark plug according to claim 13, wherein said at least one rinsing recess or opening has a circular cross section, and said recess is a slitshaped recess.

16. The spark plug according to claim 1, wherein an outer thread is formed on each of the concentrically placed end projections, and an inner thread adapted to said outer thread is formed on the inner wall surface of said wall part of said chamber and on the inner wall surface of said support, said ground electrode support and said cylindrical-ring-shaped wall part of said chamber are disposed concentrically to each other while forming the pre-set interval and/or that the cylindrical wall part and the support are placed on the particular projection and attached there by welding.

17. The spark plug according to claim 1, wherein a spacing distance between an outer surface of said ground electrode support and said wall part of said chamber is smaller than a thickness of said wall part of said chamber, and wherein a thickness of said ground electrode support is three to fifteen times a width of the spark gap, and/or wherein a spacing distance between said outer wall surface of said ground electrode support and said inner wall surface of said chamber is 50 to 200% of a width of the spark gap.

18. The spark plug according to claim 17, wherein the thickness of said ground electrode support is five to ten times the width of the spark gap.

19. The spark plug according to claim 1, which comprises a precious metal alloy or at least a platelet made of precious metal alloy disposed on circumferential areas or on locally limited elevations or on radial surface areas pointing toward said center electrode and/or on a surface of said finger-shaped ground electrode facing said center electrode, or on elevations configured on said surface, in strips that lie next to each other.

20. The spark plug according to claim 19, wherein said precious metal alloy or said platelet of precious metal alloy is applied or fused or welded on, and said strips lie next to each other and on top of one another.

21. The spark plug according to claim 1, wherein said center electrode is shaped as a compact component or as a quiver-shaped component filled with a material having high thermal conductivity and slid onto a center electrode base and welded thereto.

22. The spark plug according to claim 1, wherein an end of said wall part of a swirl chamber on the combustion chamber side projects over a side of said center electrode and/or the ground electrodes on the combustion chamber side, and wherein, said wall part of said chamber, opposite each said ground electrode, is formed with a slot extending parallel to said ground electrode.

23. The spark plug according to claim 22, wherein said slot extending parallel to said ground electrode is open to the end of said wall part on the combustion chamber side, providing access to the end area of said ground electrode.

24. The spark plug according to claim 1, wherein said wall part of said chamber and said support are electrical conductors, and are connected so as to conduct electricity with the spark plug shell and wherein each finger-shaped ground electrode is bent from its respective said support in a direction toward said center electrode and after a further bend, runs in a direction substantially parallel to said center electrode.

25. The spark plug according to claim 24, wherein at least one of said wall part of said chamber, a sheathing of said center electrode, and said at least one ground electrode with the support thereof is formed of one of a nickel-based alloy, a high-temperature steel, and hot-corrosion-resistant metal alloys with good thermal conductivity capabilities, and wherein said pre-chamber is formed of brass.

* * * * *